US009296195B2

(12) United States Patent
Koenen

(10) Patent No.: US 9,296,195 B2
(45) Date of Patent: Mar. 29, 2016

(54) METHOD FOR PRODUCING A PRINTING STENCIL FOR TECHNICAL PRINTING FOR APPLYING A PRINTED PATTERN TO A SUBSTRATE AND PRINTING STENCIL FOR TECHNICAL PRINTING

(75) Inventor: Christian Koenen, Ottobrunn-Riemerling (DE)

(73) Assignee: CHRISTIAN KOENEN GmbH, Ottobrunn-Reimerling (DE)

( * ) Notice: Subject to any disclaimer, the term of this patent is extended or adjusted under 35 U.S.C. 154(b) by 0 days.

(21) Appl. No.: 14/342,076

(22) PCT Filed: Aug. 30, 2012

(86) PCT No.: PCT/EP2012/066855

§ 371 (c)(1),
(2), (4) Date: Jun. 16, 2014

(87) PCT Pub. No.: WO2013/030273

PCT Pub. Date: Mar. 7, 2013

(65) Prior Publication Data

US 2014/0305323 A1 Oct. 16, 2014

(30) Foreign Application Priority Data

Aug. 30, 2011 (DE) ..... 10 2011 081 837

(51) Int. Cl.
*B41M 1/12* (2006.01)
*B41C 1/14* (2006.01)
*B41N 1/24* (2006.01)

(52) U.S. Cl.
CPC . *B41C 1/145* (2013.01); *B41N 1/24* (2013.01); *B41N 1/248* (2013.01)

(58) Field of Classification Search
CPC ..... B41C 1/145
USPC ..... 101/129
See application file for complete search history.

(56) References Cited

U.S. PATENT DOCUMENTS 3,668,028 A 6/1972 Short
4,598,039 A * 7/1986 Fischer et al. ..... 430/323

(Continued)

FOREIGN PATENT DOCUMENTS

DE 2128729 12/1971
DE 20 2008 004 821 U1 7/2008
DE 10 2007 052 679 A1 5/2009
DE 10 2007 059 794 A1 6/2009

(Continued)

OTHER PUBLICATIONS

Jan. 3, 2013 Search Report issued in International Patent Application No. PCT/EP2012/066855.

(Continued)

*Primary Examiner* — Anthony Nguyen
(74) *Attorney, Agent, or Firm* — Oliff PLC

(57) ABSTRACT

Disclosed is a method for producing a printing stencil for technical printing for applying a printed pattern to a substrate and to a printing stencil. The method includes supplying a carrier layer, supplying a structure layer, said layer being located beneath the carrier layer, making an elongate printed image opening, corresponding to at least part of the printed pattern, in the structure layer, and making carrier layer openings in the region of the printed image opening. The method uses a laser device designed to emit a laser beam in pulses, and includes making a row of carrier layer openings, extending in the longitudinal direction of the printed image opening, wherein, for making a carrier layer opening, a focusing apparatus is positioned near the carrier layer opening, and the carrier layer opening is by means of one or several laser pulses, and the focusing apparatus of the laser device.

29 Claims, 8 Drawing Sheets

(56) References Cited

U.S. PATENT DOCUMENTS

| | | | | |
|---|---|---|---|---|
| 5,754,219 | A * | 5/1998 | Ruckl | 347/256 |
| 5,819,652 | A * | 10/1998 | Utter et al. | 101/128.21 |
| 5,887,520 | A * | 3/1999 | Kinoshita | 101/128.4 |
| 6,427,587 | B1 * | 8/2002 | Cobbley et al. | 101/127 |
| 2002/0166468 | A1 * | 11/2002 | Schmid | B41C 1/14 101/127 |
| 2002/0179580 | A1 * | 12/2002 | Costin | 219/121.68 |
| 2007/0042527 | A1 * | 2/2007 | Tuckerman | H01L 23/06 438/106 |

FOREIGN PATENT DOCUMENTS

| | | | |
|---|---|---|---|
| DE | 10 2011 003 287 | A1 | 8/2012 |
| EP | 2 292 440 | A1 | 3/2011 |
| JP | A 2010-260307 | | 11/2010 |

OTHER PUBLICATIONS

Mar. 4, 2014 International Preliminary Report on Patentability issued in in International Patent Application No. PCT/EP2012/066855.

* cited by examiner

Fig. 1 - Related Art
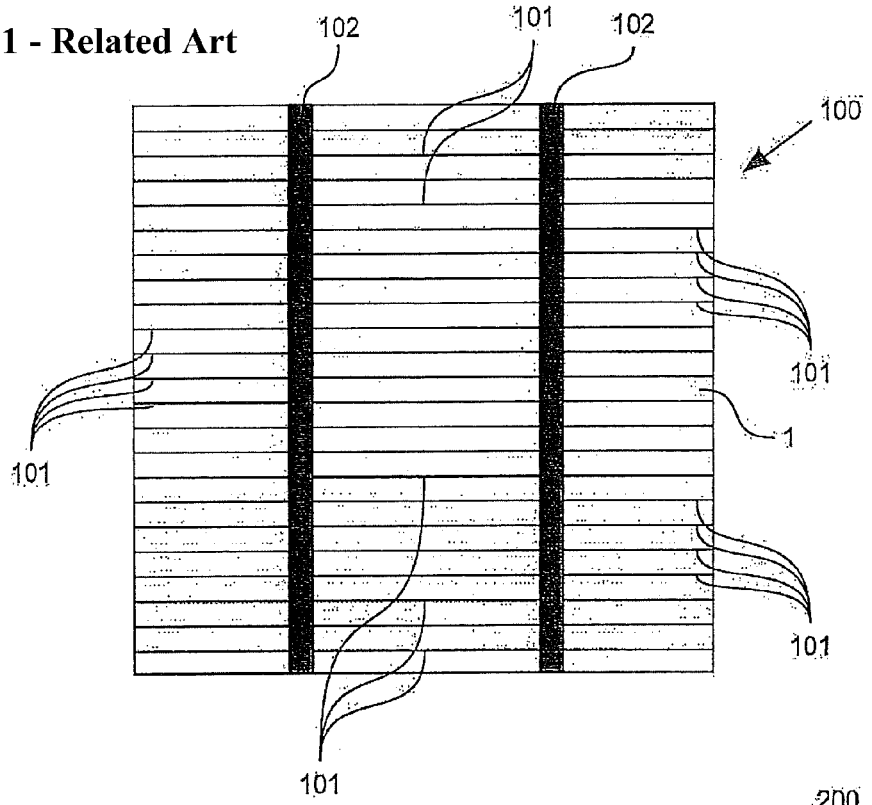
Fig. 2A - Related Art
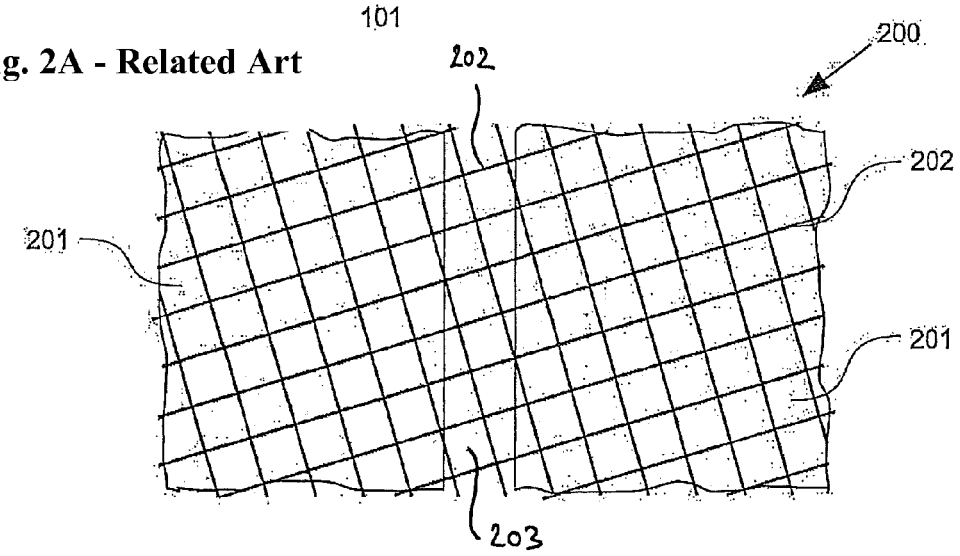
Fig. 2B - Related Art
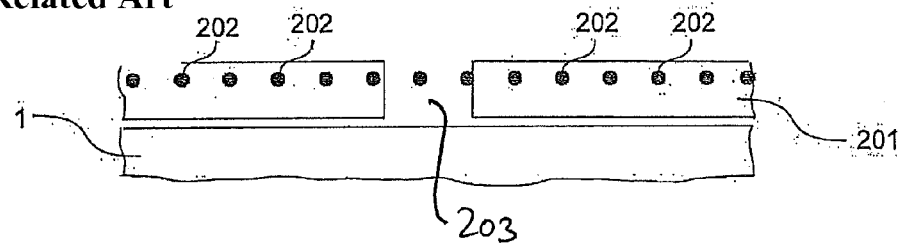

METHOD FOR PRODUCING A PRINTING STENCIL FOR TECHNICAL PRINTING FOR APPLYING A PRINTED PATTERN TO A SUBSTRATE AND PRINTING STENCIL FOR TECHNICAL PRINTING

The present invention relates to a method for producing a printing stencil for technical printing, in particular for solar cell printing, for applying a printed pattern to a substrate, in particular a substrate of a solar cell, for example for printing a front or rear side contact of the solar cell.

The manufacturing method comprises supplying a carrier layer for the printing stencil, supplying a structure layer for the printing stencil, said layer being located beneath the carrier layer, making an elongate printed image opening, corresponding to at least part of the printed pattern, in the structure layer, and making carrier layer openings in the carrier layer in the region of the printed image opening by means of laser cutting in such a way that a printing medium can be applied to the substrate through the carrier layer openings and the printed image opening.

Furthermore, the present invention relates to a printing stencil for technical printing, in particular for solar cell printing, for applying a printed pattern to a substrate, in particular a substrate of a solar cell, comprising a carrier layer for the printed stencil, a structure layer for the printing stencil, said layer being located beneath the carrier layer, wherein the structure layer has an elongate printed image opening, corresponding to at least part of the printed pattern, in the structure layer, and wherein the carrier layer comprises carrier layer openings in the region of the printed image opening.

Such printing stencils can be provided for solar cell printing, for example, i.e. e.g. for applying a contact, in particular a front contact, of a solar cell. In the case of printing stencils provided for solar cell printing, the elongate printed image openings of the structure layer can be provided for printing contact fingers of a front contact of the solar cell, for example. However, the present invention is not limited to printing stencils for solar cell printing but in addition also relates e.g. to special and hybrid stencils having at least one carrier layer and at least one structure layer for applying metallizations to substrate surfaces.

BACKGROUND OF THE INVENTION

It is conventionally known from the prior art to apply in technical solar cell printing a contact to a substrate of a solar cell by means of a printing screen. In particular it is conventionally known to print a metallization, contact and/or conductor tracks of a contact for a solar cell using printing screens by applying a printing paste which usually contains silver by means of a doctor blade through printed image openings of a printing screen to a substrate of the solar cell, wherein the printed image openings of the printing screen substantially correspond to the printed image or at least to part of the printed image of the solar cell contact to be printed.

Such printing screens have a wire screen mesh which is clamped in a frame, is embedded in a structure layer, such as a thin photoemulsion layer (see a printing screen according to DE 10 2007 052 679 A1, for example), and carries the structure layer and/or acts as a carrier layer for the structure layer. Such a photoemulsion layer has the printed image openings corresponding to the printed image of the contact to be printed, wherein the screen mesh stabilizing the photoemulsion layer also extends in the region of the printed image openings of the structure layer. For the production of such printing screens, the wire screen mesh is usually clamped on a frame and is then coated with a photosensitive material (e.g. an emulsion layer or a film). Then, the printed image is structured by exposing the photosensitive material, for example.

However, the use of such printing screens for applying the contact of the solar cell to the solar cell substrate involves drawbacks, in particular with respect to the printing of what is called the contact fingers of a front contact for the solar cell. The contact fingers shall be printed onto the substrate with the least possible width (e.g. in the range from about 20 μm to 100 μm) at a height as uniform as possible to render possible a conductor cross-section (resistance) which is as uniform as possible and to increase the energy efficiency of the solar cell. At the same time, a power line having the least possible electric resistance has to be enabled by the contact fingers with respect to the energy efficiency of the solar cell, i.e. the contact fingers must have the largest possible aspect ratio since the electric resistance of the contact fingers depends on the cross-section of the contact fingers. Possible constrictions of the contact finger reduce the conductivity of the finger, thus lowering the overall efficiency of the solar cell. Hence, the aspect ratio of the contact fingers shall be uniform, in particular over the entire length of the contact fingers, if possible.

The below described drawbacks result when printing screens are used, in particular for applying the contact of the solar cell to the solar cell substrate. The screen mesh and in particular intersections of the screen mesh in the region of the printed image openings of the photoemulsion layer impair the uniformity of the application of the paste to the substrate of the solar cell during the printing process. This leads to disadvantageous constrictions in the conductor cross-section of the contact fingers and to a disadvantageous corrugated edge of the printed image, particularly resulting from screen mesh intersections closely abutting against the print edge (edge of the printed image opening). Furthermore, the maximum paste strength achievable and thus the maximum height of the printed contact fingers achievable, with respect to which the aspect ratio is directly proportional, are highly limited by the screen mesh structure in the region of the printed image openings.

Furthermore, the mesh is expanded during the printing process as a result of the contact pressure and the movement of the doctor blade on account of the resilient properties of the screen mesh, which may distort the printed image. When the substrate is printed several times using various printing screens, a printing process is usually carried out in several steps with various screens to print parts of the contact in steps. When conventional printing screens are used, asymmetries in the overall printed image can occur in transitional regions of the overall printed image, in which printed images of various printing screens border on one another, on account of the above described distortion of the individual partial printed images.

In addition, the use of printing screens requires a very fine mesh serving for stabilizing the printing screen due to the aspired large open region of the printed pattern of the screens. However, said mesh is highly susceptible to damage, thus only permitting short service lives.

With respect to the above described drawbacks regarding the use of conventionally known printing screens for printing solar cell substrates so as to apply a contact to a substrate, in particular to a substrate of a solar cell, patent application DE 10 2011 003 287 proposes a solution for applying a contact to a substrate, in particular to a substrate of a solar cell.

A printing stencil proposed according to DE 10 2011 003 287 comprises a carrier layer and a structure layer for the printing stencil, said layer being located beneath the carrier layer, wherein the structure layer has an elongate printed image opening, corresponding to at least part of the printed pattern. The elongate printed image opening in the structure layer here corresponds e.g. to the printed pattern of a contact finger of a front side contact for a solar cell. In the region of the printed image opening, the carrier layer comprises elongate carrier layer openings which extend in the longitudinal direction of the printed image opening, are substantially rectangular and/or optionally slightly rounded on the corners and, in each case, are separated from one another by a stabilizing web. The printing stencil is suited to apply to the substrate a printing medium, such as a contacting material, through at least one opening by overlaying, in a top view of the printing stencil, the carrier layer openings with the printed image opening in such a way that the printing stencil has an opening which is formed from the printed image opening and the carrier layer openings and through which the printing medium, such as a contacting material, can be applied to the substrate. The printing medium extends below the carrier layer to give a uniform 3-dimensional form.

According to a prior art method, the carrier layer openings can be made in the carrier layer by means of laser cuffing. Here, it is conventionally known to position and focus a laser beam of a laser device by means of a focusing apparatus at a position at the edge (e.g. in a corner) of a carrier layer opening to be made. In doing so, the laser beam is substantially focused directly on the surface of the carrier layer (i.e. substantially in a focal point focused directly on the surface of the carrier layer), optionally some μm above or below the surface of the carrier layer depending on the laser cuffing method. Having opened a shutter apparatus of the laser device, the focusing apparatus is controlled so as to guide the laser beam for cuffing out the carrier layer opening along the edge of the carrier layer opening to be made to cut the carrier layer opening along the edge out of the carrier layer (see e.g. FIG. 3A).

In this connection, it is necessary to guide the laser beam with very high precision when the carrier layer openings are made, and furthermore the focused laser beam must be guided once around the entire circumference of each carrier layer opening. Therefore, such a manufacturing method is very time-consuming. If the printed image opening of the structure layer is a printed image opening for a contact finger of a front contact for a solar cell, it is necessary to cut out a plurality of individual carrier layer openings for each of the numerous contact fingers, and therefore the periods for making the carrier layer openings for the production of a single printing stencil are very long and additionally require the use of very cost-intensive laser cuffing devices.

SUMMARY OF THE INVENTION

With respect to the above described time-consuming and cost-intensive production of printing stencils which have a carrier layer and a structure layer, an object of the invention is to improve the production of printing stencils including a carrier layer and a structure layer so as to carry out the production in an easier, more cost-effective and more time-efficient fashion.

In order to achieve the above describe object of the present invention, a method for producing a printing stencil and a printing stencil produced with such a method are proposed according to the independent claims. Dependent claims relate to preferred embodiments of the present invention.

The present invention is based on the concept of not cuffing the carrier layer openings of the carrier layer out of the carrier layer by means of a focused laser beam along the edge of the carrier layer openings to be made, as known from conventional laser cuffing methods, but of making them or "shooting them out" by means of a defocused laser beam, wherein the laser beam is not focused (as usual) but is defocused depending on the width of the carrier layer openings.

In particular, a concept of the invention can be seen in the fact that the defocused cross-section of the laser beam has a width chosen depending on the width of the carrier layer openings at the height of the carrier layer surface on the laser entry side and is not basically focused to give a focal point, as is the case in conventional methods.

On the basis of this fundamental concept of the present invention, it can advantageously be achieved to already make or "shoot out" an opening in the carrier layer in accordance with the width of the carrier layer opening to be made by means or one or optionally several laser pulses at a position of the carrier layer, the cross-sectional shape of the opening substantially corresponding to the cross-sectional shape of the defocused laser beam. The production of a printing stencil can thus be carried out in an easier, more cost-effective and more time-efficient fashion since the carrier layer openings do not have to be cut out by a time-consuming method using a focused laser beam along the circumference of the carrier layer openings to be made but carrier layer openings having widths ranging from 20 μm to 100 μm can already be made or "shot out" by means of one or several laser pulses. This saves a considerable amount of time compared to the conventional methods, wherein the saving is not in the lower percentage range but can rather accelerate the production of the printing stencils by ten to eighty times.

It is preferably useful to make a width of the cross-section of the defocused laser beam at the height of the carrier layer surface on the laser entry side to be somewhat smaller than the desired width of the carrier layer opening to be made (about 50% to 95%, depending on the thickness and the material of the carrier layer) since the thermal energy introduced by means of the laser beam can lead to the fact that the carrier layer opening made is larger than the cross-section of the defocused laser beam used.

A first aspect of the present invention proposes a method for producing a printing stencil for technical printing for applying a printed pattern to a substrate, comprising the steps of supplying a carrier layer for the printing stencil, supplying a structure layer for the printing stencil, said layer being located beneath the carrier layer, in particular with a layer thickness of more than 5 μm, making an elongate or longitudinally extending printed image opening, corresponding to at least part of the printing pattern, in the structure layer, and making carrier layer openings in the carrier layer in the region of the printed image opening in such as way that a printing medium can be applied to the substrate through the carrier layer openings and the printed image opening.

The method according to the invention is characterized in that a laser beam defocused depending on the width of the carrier layer openings to be made is used for making the carrier layer openings, i.e. in particular a laser beam which is not focused in a focal point lying substantially at the height of the surface of the carrier layer or lying slightly above or below the surface of the carrier layer, as in conventional methods, but is substantially defocused at the height of the surface of the carrier layer and, in particular at the height of the surface of the carrier layer, has a cross-section having widths of more 10 μm, preferably more than 20 μm. As already mentioned above, the production of a printing stencil can thus be carried out in an easier, more cost-effective and more time-efficient fashion since the carrier layer openings do not have to be cut out by a time-consuming method of a focused laser beam along the circumference of the carrier layer openings to be made but wider carrier layer openings can be made or "shot out" by means of as few as one or several laser pulses.

A laser device is preferably used for making the carrier layer openings. Said device comprises a focusing apparatus and is designed to emit the laser beam in laser pulses and adjust it by means of the focusing apparatus so as to defocus the laser beam at the height of the surface of the carrier layer depending on the width of the carrier layer openings to be made. In this connection, it is possible to use both pulse laser devices which emit a pulsed laser beam and also laser devices which comprise a laser source and emit a continuous laser beam which is influenced by means of a periodically opening and/or closing shutter apparatus, in particular by means of a shutter apparatus which opens and closes at high frequency.

The laser beam is preferably defocused in such a way that the width of the cross-section of the laser beam at the height of the surface of the carrier layer has about 50% to 95% of the width of the carrier layer openings to be made by means of one or several laser pulses. As already mentioned, it is preferably useful to dimension a width of the cross-section of the defocused laser beam at the height of the carrier layer surface on the laser entry side so as to be somewhat smaller than the desired width of the carrier layer opening to be made (about 50% to 95%, depending on the thickness and the material of the carrier layer) since the thermal energy introduced by means of the laser beam can lead to the fact that the carrier layer opening made is larger than the cross-section of the defocused laser beam employed.

The task of making the carrier layer openings preferably comprises making a row of carrier layer openings, which extend in the longitudinal direction of the printed image opening, wherein after making a carrier layer opening the position of the laser beam is moved to a position of the carrier layer opening to be subsequently made between two successive laser pulses relative to the carrier layer and in the longitudinal direction of the printed image opening. This makes it possible to form a stabilizing web between carrier layer openings in a time-efficient and simple way in the carrier layer so as to move the position of the laser from one carrier layer opening to the next carrier layer opening to be made between two laser pulses relative to the carrier layer.

According to the particularly useful preferred exemplary embodiment, the position of the laser beam is positioned at a position of the respective carrier layer opening when a respective carrier layer opening of the row is made, and the respective carrier layer opening is preferably made at this position by means of one or several laser pulses, in particular by means of preferably one or two to ten laser pulses. According to this particularly useful preferred exemplary embodiment, the position of the laser beam is preferably not moved while the respective carrier layer opening is made by means of one or several laser pulses.

The above mentioned, particularly useful preferred exemplary embodiment is based on the concept of not cutting individual carrier layer openings out of the carrier layer by means of a focused laser beam each, as done in conventionally known laser cutting methods, by guiding the laser beam along the edge of the carrier layer opening to be made.

According to the invention it is rather provided to make the individual carrier layer openings in each case by a single positioning of the laser beam on the carrier layer in the region of the printed image opening of the structure layer at the position of the carrier layer opening to be made, preferably by means of one or also two to several laser pulses of a pulsed laser beam at substantially the same position. The distance of the carrier layer openings can here be controlled by means of the pulse frequency of the laser and/or by the feed.

Having made the carrier layer opening, it is also provided in the above described, particularly useful, preferred exemplary embodiment to guide the position of the laser beam on the carrier layer between two laser pulses to the position of the next carrier layer opening to be made so as to there make the next carrier layer opening to be made by means of the subsequent one or several laser pulses. These steps are repeated until all carrier layer openings of a row of two or several carrier layer openings are made in the region of the printed image opening. According to the method of this exemplary embodiment it is thus possible to make a whole row of carrier layer openings along the longitudinal direction of the printed image opening in an extremely simple and advantageous way in a minimum of time. For this purpose, it is not essential whether the structure layer is provided before or after making the carrier layer openings, in particular whether the structure layer is applied to the carrier layer or an intermediate layer before or after making the carrier layer openings.

Compared to conventionally known laser cutting methods, it is thus possible in a particularly advantageous and much more time-efficient and thus also cost-saving way to make carrier layer openings in the entire region of the elongate printed image opening of the structure layer. Only one or in rare cases, when the carrier layers are very thick, two to several short laser pulses are necessary to make the individual carrier layer openings at frequencies of about 0.9 to 3 kHz, optionally depending on the laser type employed, and it is thus possible to always make the rows of carrier layer openings in the region of the printed image opening in a minimum of time by moving the carrier layer relative to the laser beam position between two laser pulses.

In the method according to the above described, particularly useful exemplary embodiment, the shape of the individual carrier layer openings are predetermined mainly by the shape of the cross-section of the laser beam at the height of the carrier layer (in particular the shape of the cross-section of the laser beam at the height of the carrier layer surface on the laser entry side) since the respective carrier layer openings are made or "shot out" by individual laser pulses at a position of the carrier layer and are not cut out along the circumference of the carrier layer opening by guiding a focused laser beam.

In the case of a substantially circularly defocused laser beam, the individual carrier layer openings are thus made substantially in circular fashion, for example, when the carrier layer is not moved relative to the focusing apparatus and/or to the laser beam. If the carrier layer is moved when the laser pulse is applied, elongate carrier layer openings which are rounded at the ends and have a shape corresponding to that of an oblong hole are formed in accordance with the movement, i.e. oblong hole-shaped carrier layer openings are formed. The width of the carrier layer openings is substantially determined by the dimension of the defocused cross-section of the laser beam on the surface of the carrier layer, wherein a wider carrier layer opening can generally result on account of the introduced thermal energy. For example, a laser cross-section having a width of 20 μm can make a carrier layer opening having a width of up to 25 μm due to the radiation of the thermal energy to the sides, without changing the position of the laser beam.

Since the energy density of the laser beam decreases in absolute terms when the cross-section of the laser beam defocused on the carrier layer is increased, the upper size of the carrier layer openings achievable by means of one or some few laser pulses is limited. However, it is possible to achieve carrier layer opening diameters of up to 300 μm in the practical field of application and it is in particular possible in the case of conventional carrier layer thicknesses of 20 μm to 800 μm to make carrier layer openings having diameters in the range of below 20 μm up to about 150 μm with only one laser pulse at frequencies of 0.9 to 3 kHz. This corresponds e.g. to the common widths of printed image openings for printing contact fingers of a front contact for solar cells in the range of about 20 to 100 μm, and therefore it is possible in connection with such printed image openings to form a single row of carrier layer openings already made in each case with individual laser pulses in the region of the printed image opening.

In order to improve the stability of the stencil, respective webs can here be left in the carrier layer between two carrier layer openings. The width of the webs can be influenced, depending on the requirement, by the time between two laser pulses (i.e. e.g. by the difference from period T and pulse duration τ at any pulse-duty factor of the pulsed laser or at a 50% pulse-duty factor by half the period T or the inverse value from two times the frequency) and by the feed rate of the carrier layer relative to the positioning of the laser beam between two laser pulses.

The above described method of the particularly useful embodiment leads to more webs for an elongate printed image opening compared to the conventional laser cutting method since the length of the carrier layer openings corresponds for process-related reasons approximately to the width of the carrier layer openings (e.g. in the case of substantially circular or elliptic carrier layer openings) when the laser beam is substantially not moved while the carrier layer openings are made in contrast to the highly elongate or rectangular carrier layer openings resulting from conventional laser cuffing methods. The same stability or an even considerably better stability can thus be achieved even if the web widths are significantly reduced to approximately 10 μm to 20 μm. In the case of conventional laser cuffing methods, web widths of at least 30 μm or more are necessary with conventional laser cutting methods. In general, it is sufficient for the web width to substantially correspond to the thickness of the carrier layer to ensure a good stability.

Due to the reduced longitudinal extension of the carrier layer openings and the increased number of webs in the region of the printed image opening there is also a significantly improved doctor blade property compared to printing screens and also printing stencils in which the carrier layer openings are formed by means of a conventional laser cuffing method since a doctor blade rests more uniformly during the printing process on account of the closer webs and cannot be caught at the edges of the carrier layer openings. Thus, the wear of the stencil and of the employed doctor blade can also be reduced considerably when used several times.

Such an increase in the number of webs in the region of the printed image opening surprisingly fails to deteriorate the printed image as is known from the use of printing screens having narrow mesh width and would have to be expected at first view. Nevertheless, it is still possible to obtain an excellent printed image in a particularly advantageous fashion since the webs in the carrier layer are partially melted for process-related reasons on the laser entry side and/or on the side of the structure layer, in particular in the case of web widths of about 10 μm to 20 μm, thus being reduced as regards the height extension.

An introduced printing paste can thus excellently be collected beneath the molten webs and yields a clean printed image over the entire length of the printed image opening. In particular, a uniform height of the printing medium can surprisingly be achieved in spite of a great number of webs in the entire region of the printed image opening. This is of particular advantage for printing contact fingers of a front contact for a solar cell since an adequate finger height can be achieved over the entire region of the contact finger, and therefore the electric resistance of the contact finger can be kept small on account of a high uniform aspect ratio. If contact fingers of a front contact for a solar cell are printed, the printed image can thus be improved significantly compared to the printed image of printing screens and also to printing stencils in which the carrier layer openings are formed by means of a conventional laser cuffing method.

Should it still be desired to reduce the number of webs in the region of the printed image opening of the structure layer by reducing the number of carrier layer openings and to simultaneously increase the longitudinal extension of the carrier layer openings, the excellent saving of time can still be provided by means of the method according to the invention. For this purpose, an alternative but also particularly useful exemplary embodiment is described below.

In the alternative, particularly useful exemplary embodiment, the difference with respect to the above described exemplary embodiment is that the position of the laser beam relative to the carrier layer is also moved during the laser pulses and not only between the laser pulses of the laser beam.

When a respective carrier layer opening of the row is made, the position of the laser beam is here preferably positioned at a first position of the respective carrier layer opening to be made and the respective carrier layer opening is made by means of a laser pulse by moving the position of the laser beam during one laser pulse from the first position to a second position of the respective carrier layer opening. The position of the laser beam is preferably moved during one laser pulse from the first position to the second position of the respective carrier layer opening in the longitudinal direction of the printed image opening. Thus, it is not a carrier layer opening having a cross-sectional shape corresponding to the cross-sectional shape of the defocused laser beam that is formed on the surface of the carrier layer but a carrier layer opening which has the shape of an oblong hole and the ends of which have a shape which is caused by the cross-sectional shape of the defocused laser beam (e.g. semi-circular ends with a circular cross-section of the defocused laser beam or semi-elliptic ends with an elliptic cross-section of the defocussed laser beam).

The feed rate in the movement of the position of the laser beam relative to the carrier layer from the first position to the second position of the carrier layer opening to be made and/or the pulse duration of the laser pulse of the laser beam are preferably chosen depending on the length of the carrier layer opening to be made.

Irrespective of the concrete embodiment, the method according to the first aspect preferably also comprises a step of adjusting a shape and/or size of the cross-section of the defocused laser beam at the height of the surface of the carrier layer by means of the focusing device of the laser device. It is here preferred to adjust the width of the cross-section of the laser beam to the height of the surface of the carrier layer transversely to the longitudinal alignment of the printed image opening depending on the width of the printed image opening. As already described above, this has the advantage to influence the size and/or shape of the carrier layer openings made in accordance with the requirements.

In particular, the width of the carrier layer openings can be adapted to the width of the printed image opening of the structure layer by adjustments to the focusing apparatus of the laser device. The laser beam is preferably defocused by means of the focusing apparatus with a substantially circular cross-section at the height of the surface of the carrier layer.

According to an alternative preferred exemplary embodiment, the laser beam is defocused by means of the focusing apparatus with a substantially elliptic cross-section at the height of the surface of the carrier layer. The elliptic main axes of the carrier layer openings are here preferably aligned transversely, in particular perpendicularly, to the longitudinal direction of the printed image opening. As a result, it is advantageously possible to render the resulting form of the webs more uniform, in particular provide it with a more uniform width in the transverse direction of the printed image opening on account of the elliptic shape of the carrier layer openings.

Furthermore, the method preferably comprises a step of adjusting one or several of the parameters frequency and/or period of the pulsed laser beam, pulse duration of the laser pulses, duty cycle of the pulsed laser beam, on/off ratio of the pulsed laser beam. This enables, for example, to influence and/or adjust the width of the webs between adjacent carrier layer openings made depending on the adjusted feed rate when the carrier layer is moved relative to the focusing apparatus of the laser device. In this connection, said parameters depend on one another, and the other parameters are generally already determined by adjusting two of said parameters.

When the position of the laser beam is moved relative to the carrier layer between two successive laser pulses between two adjacent carrier layer openings of the row of carrier layer openings, a web is preferably formed in the carrier layer. As already described above, it is thus possible to advantageously increase the stability of the printing stencil, in particular in the case of highly elongate printed image openings, said stability being necessary for printing contact fingers of a front contact for a solar cell, for example.

When the position of the laser beam is moved relative to the carrier layer from a position of a carrier layer opening made to a position of a carrier layer opening to be subsequently made, the feed rate is preferably chosen depending on a predetermined web width. When the position of the laser beam is moved relative to the carrier layer from a position of a carrier layer opening made to a position of a carrier layer opening to be subsequently made, the feed rate is also preferably chosen depending on the width of the carrier layer openings in the longitudinal direction of the printed image opening or on the basis of the width of the cross-section of the defocused laser beam at the height of the surface of the carrier layer.

When the position of the laser is moved relative to the carrier layer from the position of a carrier layer opening made to the position of a carrier layer opening to be subsequently made, the feed rate is preferably chosen to be in particular smaller or substantially equal $(BL+SB)/(T-\tau)$, wherein BL designates the width of the carrier layer openings in the longitudinal direction of the printed image opening (this applies to an embodiment where the position of the laser beam is not moved when the carrier layer opening is made; in the case of methods in which the position of the laser beam is also moved when a carrier layer opening is made, BL should be chosen depending on the width of the cross-section of the defocused laser, wherein BL should, however, be chosen to be somewhat larger), SB designates the predetermined web width, T is the period of the pulsed laser beam and $\tau$ is the pulse duration of the laser pulses. Thus, the carrier layer can advantageously be moved relative to the focusing apparatus of the laser device in the period of time between two laser pulses (e.g. given as $T-\tau$) at least by a distance corresponding to the sum of the width of the carrier layer openings in the longitudinal direction of the printed image opening and the predetermined web width to leave a web of predetermined width in the carrier layer.

The focusing apparatus is preferably moved when the position of the laser beam is moved relative to the carrier layer. Alternatively or additionally, it is also possible to move the carrier layer when the focusing apparatus of the laser device is moved relative to the carrier layer. In this connection, the movement can be carried out continuously while making a row of carrier layer openings when the carrier layer openings are already made or "shot out" in each case with only one laser pulse. Alternatively, the movement can also be carried out step-wise while making a row of carrier layer openings by being moved substantially by a distance corresponding to the sum of the width of the carrier layer openings in the longitudinal direction of the printed image opening and the predetermined web width between two pulses so as to be stopped at the position of the next carrier layer opening to be made until the carrier layer opening has been made after a predetermined number of one or several laser pulses to then be moved again between two successive pulses substantially by a distance corresponding to the sum of the width of the carrier layer openings in the longitudinal direction of the printed image opening and the predetermined web width to the position of the next carrier layer opening to be made.

It is preferred for the material of the carrier layer to comprise metal, in particular stainless steel or nickel, and/or a plastic material.

The structure layer preferably comprises a photosensitive material, in particular a photosensitive emulsion or a film. In this connection, making the printed image opening preferably comprises the steps of exposing the structure layer by means of electromagnetic radiation of a predetermined wavelength or a predetermined wavelength range, in particular by means of infrared, visible and/or ultraviolet light, with a printed image of the printed pattern and developing the photosensitive material of the structure layer.

The structure layer is preferably applied directly to the carrier layer or to an intermediate layer applied between the carrier layer and the structure layer.

The task of making the carrier layer openings preferably also comprises making at least one further second row of carrier layer openings, extending in the longitudinal direction of the printed image opening and parallel to the first row of carrier layer openings. Here, a focusing apparatus of the laser device can preferably be positioned at a position of the respective carrier layer opening when a respective carrier layer opening of the second row is made, and the respective carrier layer opening is preferably made by means of one or several laser pulses at this position. After making a carrier layer opening between two successive laser pulses, the focusing apparatus of the laser device is preferably moved from the position of the carrier layer opening made relative to the carrier layer and in the longitudinal direction of the elongate printed image opening to the position of the carrier layer opening to be subsequently made.

In each case, one carrier layer opening of the first row preferably overlays a carrier layer opening of the at least one further second row in such a way that each carrier layer opening is made in the produced printing stencil from two or more carrier layer openings of the at least two rows, wherein a web is preferably formed between carrier layer openings adjacent in the longitudinal direction of the printed image opening. The advantage is that even wider carrier layer openings having widths greater than the effective cross-section of the laser on the carrier layer, i.e. the cross-section with a sufficient energy density, are made in simple and time-efficient fashion according to the method of the invention by making two or several rows of carrier layer openings which are substantially arranged in parallel, wherein carrier layer openings of the various rows, which are arranged in parallel to one another, said openings being adjacent in the transverse direction to the printed image opening, are overlaid, thus forming in each case a wider carrier layer opening in the finished printing stencil, wherein respective webs can have been formed again between carrier layer openings which are adjacent in the longitudinal direction of the printed image opening.

A second aspect of the present invention proposes a printing stencil for technical printing for applying a printed pattern to a substrate, said stencil being made on the basis of a method according to the above mentioned first aspect, wherein the printing stencil comprises a carrier layer for the printing stencil and a structure layer for the printing stencil, said layer being located beneath the carrier layer. As regards the advantages of the printing stencil, reference is here made to advantages which are already described above in connection with the method according to the invention and the preferred embodiments thereof.

According to the invention, the structure layer has an elongate printed image opening, corresponding to at least part of the print pattern, in the structure layer, and the carrier layer comprises in the region of the printed image opening one or several rows of carrier layer openings, which extend in the longitudinal direction of the printed image opening. However, said carrier layer openings are not made in substantially rectangular fashion—in contrast to carrier layer openings made according to conventional laser cuffing methods—but have a round edge progress according to an effective cross-section of the laser. They optionally have a width transversely to the longitudinal direction of the printed image opening that corresponds approximately to the length in the longitudinal direction of the printed image opening, or they are formed of two or several carrier layer openings overlapping in the transverse direction to the longitudinal direction of the printed image opening, said openings all having a round edge progress according to an effective cross-section of the laser and optionally have a width transversely to the longitudinal direction of the printed image opening that corresponds approximately to the length in the longitudinal direction of the printed image opening.

The carrier layer openings of a row are preferably formed in a substantially circular fashion. Alternatively, the carrier layer openings of a row are preferably formed in a substantially elliptic fashion. Here, the elliptic main axes of the carrier layer openings of a row are aligned transversely, in particular perpendicularly, to the longitudinal direction of the printed image opening. Alternatively, the carrier layer openings of a row have substantially the shape of an oblong hole, i.e. they are elongate but have rounded ends which are either substantially semi-circular or semi-elliptic.

The material of the carrier layer preferably comprises metal, in particular stainless steel or nickel, and/or a plastic material. The structure layer preferably comprises a photosensitive material, in particular a photosensitive emulsion or a film.

The structure layer is preferably applied directly to the carrier layer or to an intermediate layer applied between the carrier layer and the structure layer.

In the region of the printed image opening, the carrier layer preferably has precisely one row of carrier layer openings, which extends in the longitudinal direction of the printed image opening, wherein one respective web is preferably formed between adjacent carrier layer openings. The respective web is preferably partially molten on the side facing the structure layer, thus having a reduced height compared to the height of the carrier layer. As described above, this can be achieved according to the invention by using the carrier layer side facing the structure layer as the laser entry side, i.e. when the laser beam impinges on the carrier layer side facing the structure layer and is rapidly carried on, said desired height differences result due to thermal effects.

According to a further useful embodiment, a carrier layer opening of a first row and a carrier layer opening of at least one further second row are overlaid in each case in such a way that each carrier layer opening in the printing stencil is formed of two or more carrier layer openings of the at least two rows, wherein a respective web is formed between carrier layer openings adjacent in the longitudinal direction of the printed image opening.

In summary, a manufacturing method for a printing stencil can be provided according to the invention, wherein respective carrier layer openings are made or "shot out" in the carrier layer for the printing stencil in the region of the printed image opening in each case by applying one or several laser pulses at a position, said method being made in a simpler and more efficient fashion and with a considerable gain of time compared to manufacturing methods in which the carrier layer openings are conventionally cut circumferentially out of the carrier layer by means of a highly focused laser beam.

Since in particular the production of the carrier layer opening on a cost-intensive laser cutting device can significantly be reduced, this improved time efficiency additionally signifies a considerably improved cost efficiency when the printing stencil is produced. Furthermore, a printing stencil produced according to the invention includes, for process-related reasons, structural improvements with respect to the printing screens and also printing stencils, where carrier laser openings are conventionally cut circumferentially out of the carrier layer by means of a highly focused laser beam since a considerably improved stability of the carrier layer and an improved doctor blade property are achieved and still an excellent printed image can be obtained, in particular when contact fingers of a front contact for a solar cell are printed.

Preferred fields of application for printing stencils according to the invention can be in particular the following: thick-film applications, printing of conductive pastes, printing of resistor pastes, printing of thermally conductive pastes or adhesives, adhesives, silicones, acrylics, pastes and emulsions having a relatively high viscosity (corresponding to the wet-film thickness), non-conductive pastes and emulsions.

BRIEF DESCRIPTION OF THE FIGURES

FIG. 1 shows a top view of a solar cell known from the prior art.

FIG. 2A shows a top view of a section of a printing screen known from the prior art, and FIG. 2B shows a cross-section of the section of the FIG. 2A printing screen which is known from the prior art.

Figure 3A:
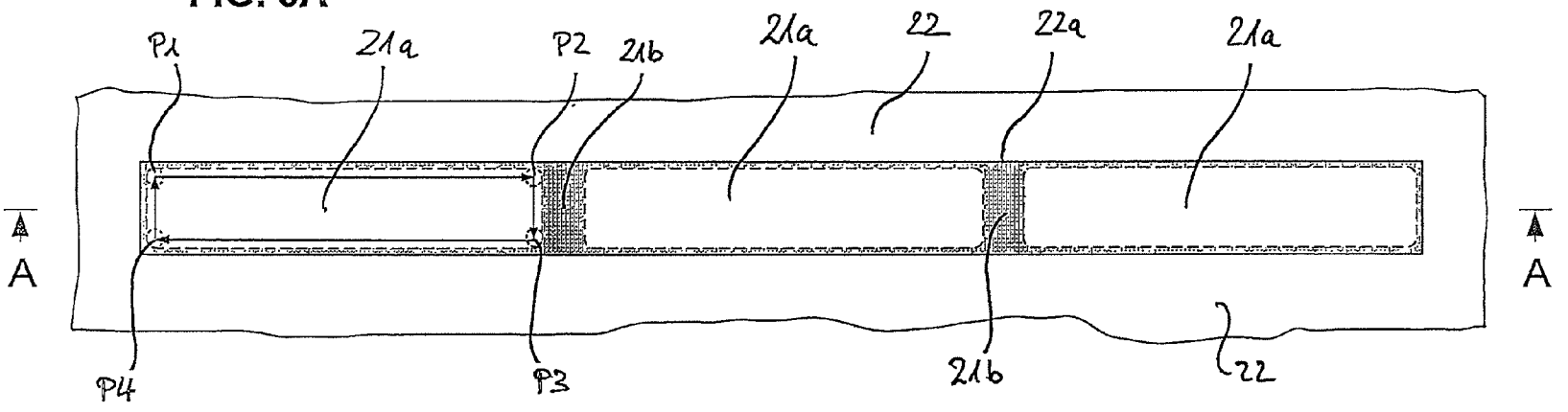
FIG. 3A shows a schematic, structure layer-side top view of a section of a printing stencil, where the carrier layer openings are conventionally cut circumferentially out of the carrier layer by means of a highly focused layer beam.

DETAILED DESCRIPTION OF THE FIGURES AND PREFERRED EXEMPLARY EMBODIMENTS OF THE INVENTION

Various exemplary embodiments of the present invention are specified below with reference to the figures. In the figures, equal or similar elements are designated by equal reference signs. However, the present invention is not limited to the described design features but also comprises modifications of features of the described exemplary embodiments and combination of features of various exemplary embodiments within the scope of the independent claims.

FIG. 1 shows by way of example a top view of a solar cell 100 known from the prior art. The solar cell 100 comprises a substantially rectangular photoactive semiconductor photovoltaic substrate layer, briefly referred to as substrate 1 below, the front side of which contains a front contact having two (optionally also several) electrically conductive busbars 102, which extend in parallel to one another, for dissipating the electric energy and for connecting the solar cell 100 to other solar cells to give a solar cell module. A plurality of contact fingers 101, which also extend parallel to one another but transversely to the busbars 102, are provided as a component of the front contact perpendicularly to the busbars 102. They conduct the electric energy produced in the substrate 1 upon the incidence of light to the busbars 102. In order to enable a high energy efficient solar cell by low electric resistances of the conductor paths and a shading which is simultaneously as low as possible, the contact fingers 101 shall be applied with the greatest possible aspect ratio which is uniform over the entire length of the contact fingers 101, i.e. great height and minimum width.

FIG. 2A shows by way of example a top view of a section of a printing screen 200 known from the prior art, and FIG. 2B shows by way of example a cross-section of the section of the printing screen 200 of FIG. 2B, which is known from the prior art. The printing screen 200 comprises a photoemulsion layer 201, which has a printed image opening 203 for printing the front side contact. The photoemulsion layer is stabilized by a screen mesh 202, which is introduced into the photoemulsion layer 201. This is in particular disadvantageous because the screen mesh 202 also fills the free printing region of the printed image opening and can thus result in a non-uniform paste imprint when the front side contact is printed, in particular in the region of the mesh nodes of the screen mesh 202, especially when the mesh nodes of the screen mesh 202 are arranged in the marginal area of the line of application (printed image opening 203).

Figure 3B:
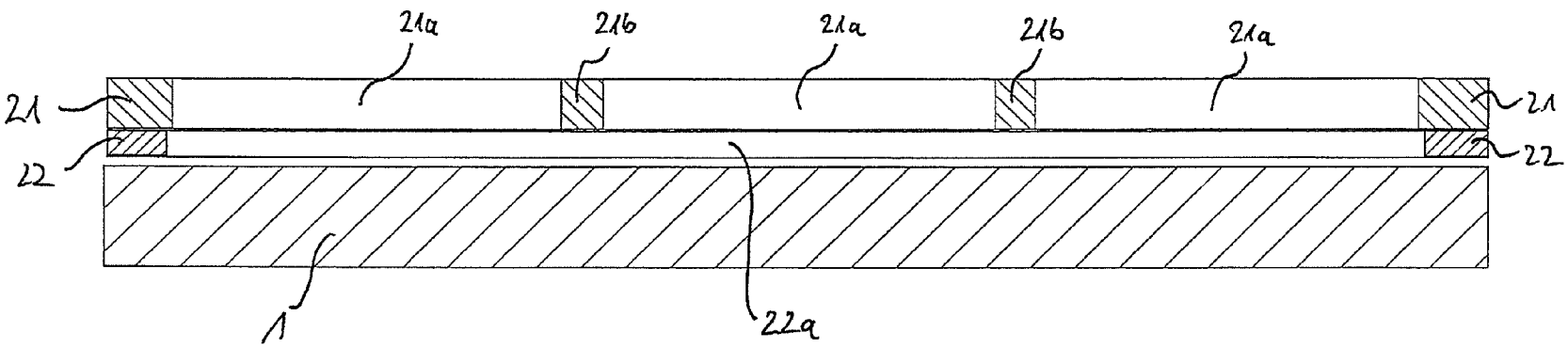
FIG. 3B shows a schematic sectional view along cutting line A-A of FIG. 3A.

FIG. 3A shows a schematic, structure layer-side top view of a section of a printing stencil, where the carrier layer openings are conventionally cut circumferentially out of the carrier layer by means of a focused laser beam. FIG. 3B shows a schematic sectional view along cutting line A-A from FIG. 3A.

FIG. 3A shows in particular by way of example a top view of a printing stencil, viewed from the side of the structure layer 22, wherein the printing stencil is produced by means of a conventionally known laser cutting method. The carrier layer openings 21*a* are cut out of the carrier layer 21 by means of the focused laser along the edge of the carrier layer openings 21*a* to be made. In the region of the elongate printed image opening 22*a* in the structure layer 22, three substantially rectangular carrier layer openings 21*a* are formed in the carrier layer 21, which are all separated from one another by a web 21*b*.

Here, for cutting out the carrier layer openings 21*a*, the laser beam is first positioned in a corner, e.g. at position P1 in FIG. 3A, and, after opening the shutter apparatus of the laser device, is then guided along the edge of the carrier layer opening 21*a* to positions P2, P3 and P4 in the respective other corners and then back to position P1 until the carrier layer opening 21*a* has been fully cut out of the carrier layer 21. Having closed the shutter apparatus of the laser device, the focused laser beam can be guided into the region of the next carrier layer opening 210 to be made to cut this next carrier layer opening 21*a* to be made out of the carrier layer 21.

Figure 4A:
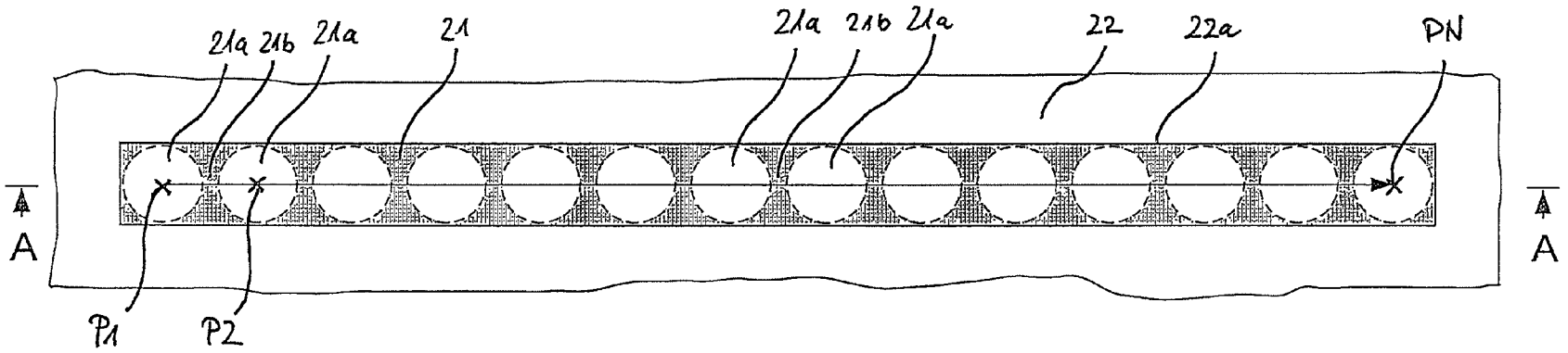
FIG. 4A shows a schematic structure layer-side top view of a section of a printing stencil, where the carrier layer openings are made on the basis of a method according to a first exemplary embodiment of the present invention.
Figure 4B:
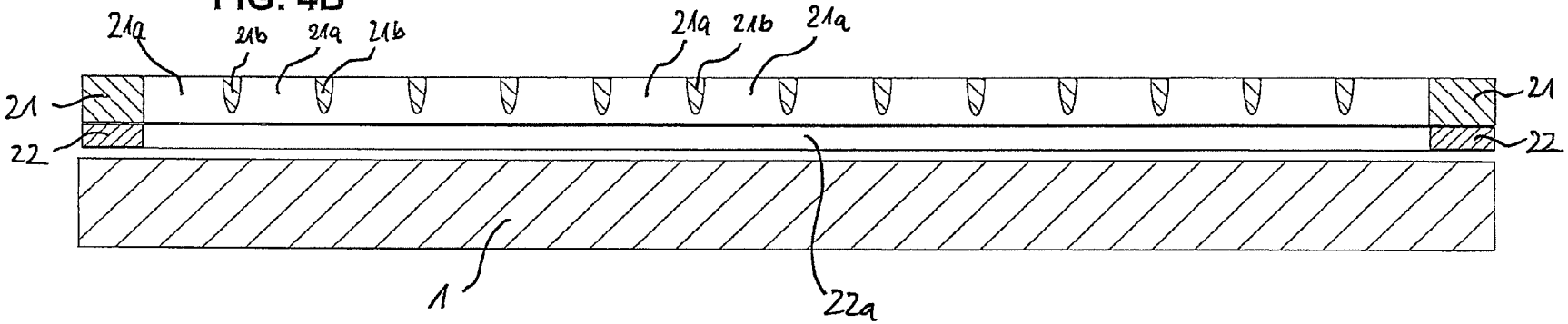
FIG. 4B shows a schematic sectional view along cuffing line A-A of FIG. 4A.
Figure 5B:
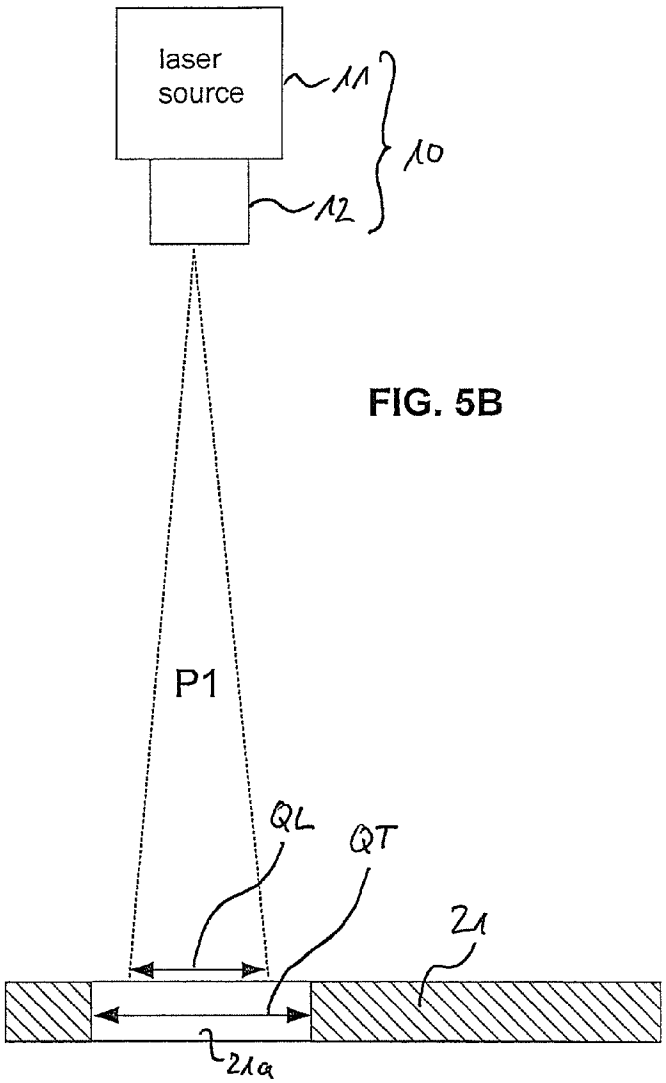
FIGS. 5A to 5D illustrate steps of a method according to an exemplary embodiment of the present invention.
Figure 5A:
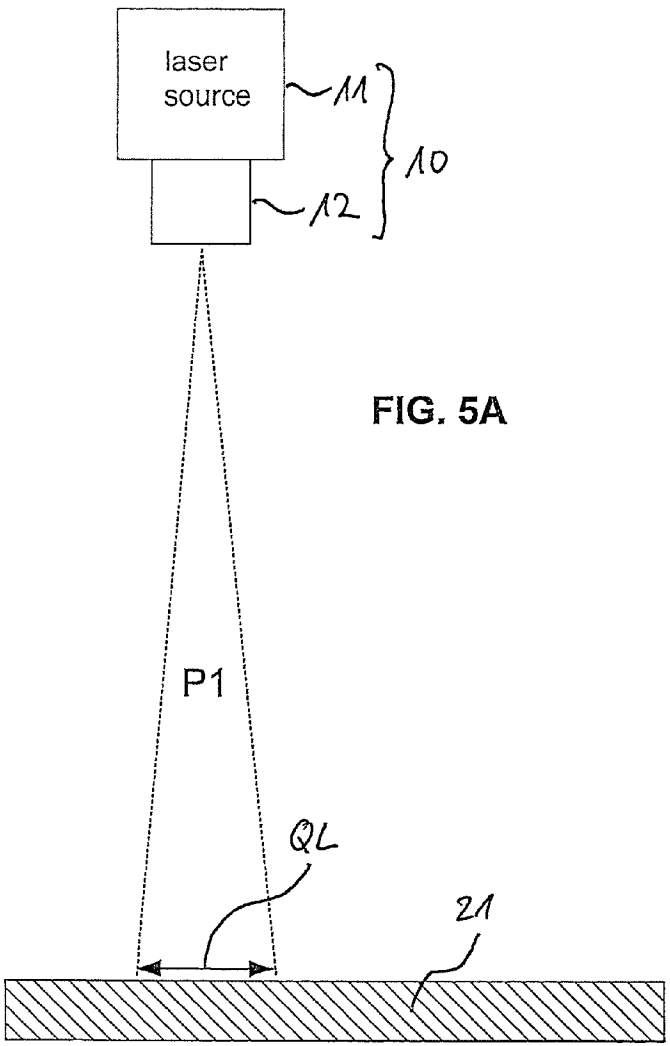
Figure 5D:
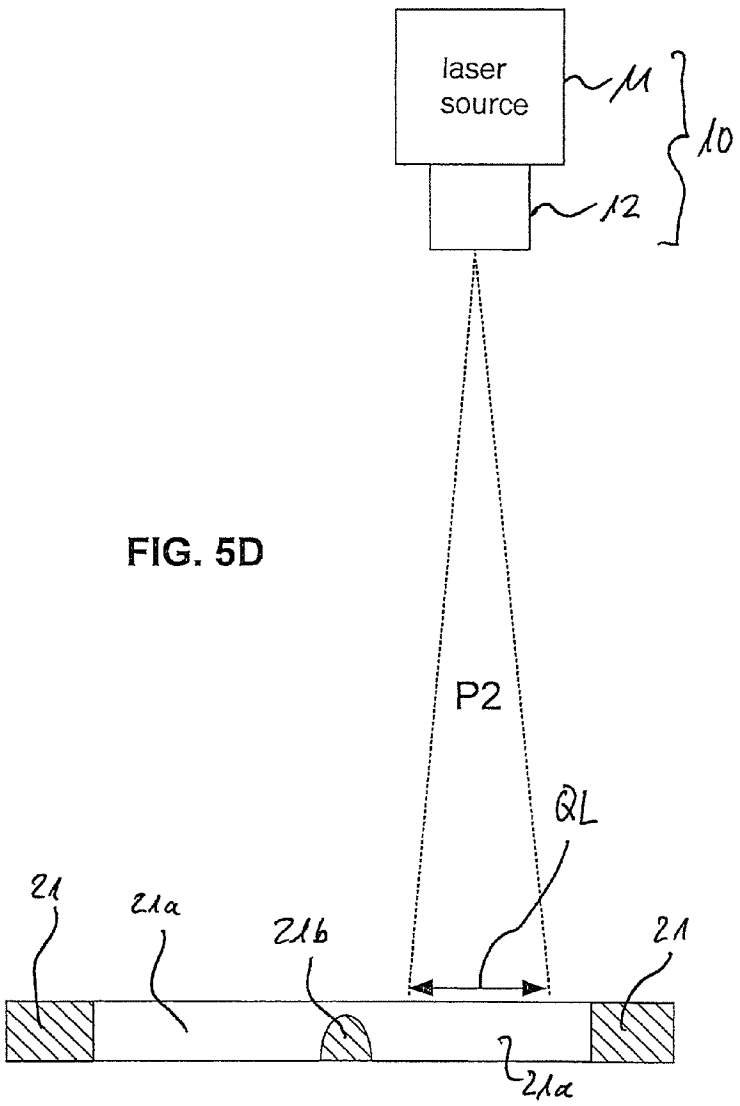
Figure 5C:
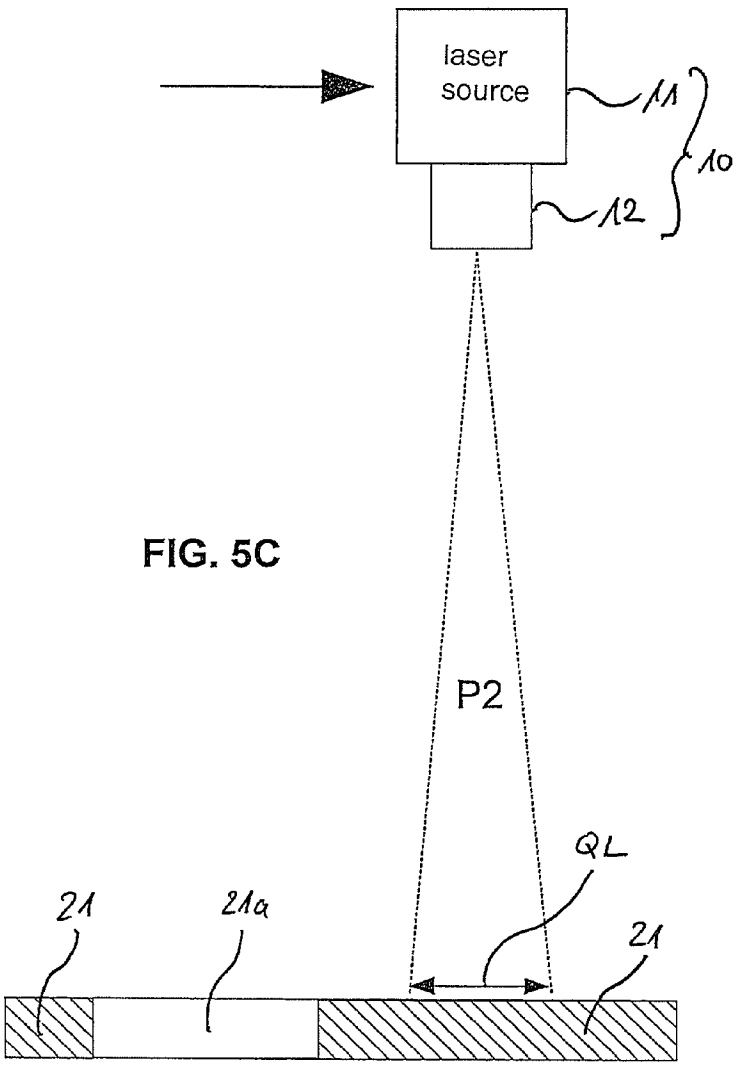

FIG. 4A shows a schematic, structure layer-side top view of a section of a printing stencil, where the carrier layer openings 21*a* are made on the basis of a method according to a first exemplary embodiment of the present invention. FIG. 4B shows a schematic sectional view along cutting line A-A of FIG. 4A.

A continuous elongate rectangular printed image opening 22*a* (e.g. for printing a contact finger of a front contact for a solar cell) is formed in the structure layer 22. In the carrier layer 21, which is located above the structure layer 22, a row of circular carrier layer openings 21*a* is made in the region of the printed image opening 22*a*, between which one web 21*b* each is formed in the carrier layer 21. The diameter of the carrier layer openings 21*a* is adapted to the width of the printed image opening 22*a* in the transverse direction of the printed image opening 22*a* and/or corresponds in FIG. 4A substantially to the width of the printed image opening 22*a*.

For printing a contact finger of a front contact for a solar cell, the dimensions might be designed in practice for example in such a way that the width of the printed image opening 22*a* and/or the diameter of the carrier layer openings 21*a* ranges from about 20 to 100 μm and the web width of the webs 21*b* (measured in the thin central region of the web, for example) ranges from 10 μm to 50 μm or preferably from about 15 μm to 30 μm.

A surprising effect of a height reduction by partial melting on the laser entry side is observable from web widths of below about 30 μm, in particular from about 20 μm, as illustrated in FIG. 4B at webs 21*b*. Such narrow web widths cannot be achieved with conventional laser cutting methods, as shown in FIG. 3A, for example, for reasons of stability. The height reduction of the webs 21*b* by partial melting on the laser entry side leads to the advantageous effect that a printing paste can be better collected beneath the webs 21*b* on the side of the substrate 1 to be printed and renders possible an improved uniform printed image over the entire length of the printed image opening.

The carrier layer openings are made at positions P1, P2 . . . to PN according to the invention by means of one or several laser pulses of a defocused laser beam. For this purpose, the carrier layer 21 and the laser device are moved from position P1 to position PN relative to one another in the longitudinal direction of the region of the printed image opening 22*a* (see arrow in FIG. 4A). The method can here be carried out continuously (in particular in the case of very short laser pulses) when the carrier layer openings 21*a* are made by means of one laser pulse each or also preferably in steps as illustrated below with reference to FIGS. 5A to 5D when the carrier layer openings 21*a* are made by means of one or several laser pulses each. In both cases, the movement from one position (e.g. P1) to the adjacent position (e.g. P2) is carried out in particular between two laser pulses.

FIGS. 5A to 5D illustrate steps of a method according to an exemplary embodiment of the present invention. According to FIG. 5A, the laser device 10 comprising a laser source 11 and a focusing apparatus 12, which includes a focusing optics, is positioned at a position P1 of a first carrier layer opening 21*a* to be made in the carrier layer 21. The laser beam is aligned to the carrier layer 21 and defocused at the height of the surface or in the carrier layer 21 by means of the focusing optics of the focusing apparatus 12 so as to include a laser cross-section QL having a size depending on the predetermined size QT of the carrier layer opening 21*a* to be made (about 50% to 90% of the predetermined size QT). In the region of the laser cross-section QL, the laser beam has an energy density which is sufficient to make a carrier layer opening depending on the carrier layer thickness by means of one or several laser pulses of a predetermined number n. The laser cross-section QL should here generally be chosen somewhat smaller than the predetermined size QT since the thermal energy in the carrier layer irradiates laterally and makes a carrier layer opening, the cross-section of which is larger than the cross-section QL of the defocused laser beam.

Having positioned the laser device 10 at position P1, the laser device 10 remains at position P1 for a predetermined period of time until the predetermined number n of laser pulses has been emitted, i.e. for a predetermined period of time corresponding to n times the period T or n times the inverse value of the frequency of the pulsed laser of the laser device 10 (preferably precisely for the duration of a laser pulse, i.e. preferably n=1). Then, the carrier layer opening 21*a* is made or "shot out" at position P1 as shown schematically in FIG. 5B. After the n-th laser pulse, the laser device 10 is moved relative to the carrier layer 21 to position P2 of the next carrier layer opening 21*a* to be made and is positioned at position P2, as shown schematically in FIG. 5C. The movement is carried out between the n-th and the subsequent (n+1)-th laser pulse. However, it is not essential for the invention whether the laser device 10 as a whole, the focusing device 12 and/or the carrier layer 21 is actually moved.

Having positioned the laser device 10 at position P2, the laser device 10 is left at position P2 for a predetermined period of time until a predetermined number m of laser pulse has been emitted (preferably wherein m=n, in particular preferably m=1), i.e. for a predetermined period of time according to m times the period T or m times the inverse value of the frequency of the pulsed laser of the laser device 10. Then, the carrier layer opening 21*a* is made or "shot out" at position P2 as shown schematically in FIG. 5D. In this connection, the surprising and advantageous effect of the height reduction of the web 21*b* occurs with web widths below about 30 μm, in particular at about 20 μm and less, as described above, by partial melting on the laser entry side of the carrier layer 21. After the m-th laser pulse, the laser device 10 can be moved relative to the carrier layer 21 to the position of the next carrier layer opening 21*a* to be made and the steps can be repeated until the last position PN in the row of carrier layer openings 21*a* has been achieved and the last carrier layer opening of the row has been made.

Figure 6:
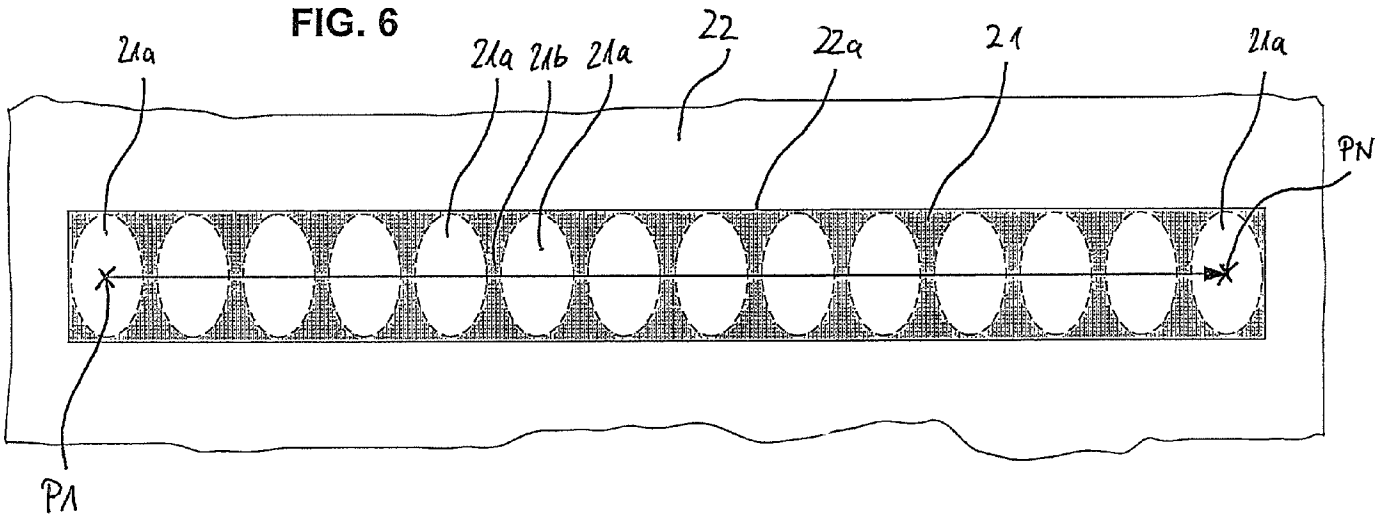
FIG. 6 shows a schematic, structure layer-side top view of a section of a printing stencil, where the carrier layer openings are made on the basis of a method according to a second exemplary embodiment of the present invention.

FIG. 6 shows a schematic, structure layer-side top view of a section of a printing stencil, where the carrier layer openings 21*a* are made on the basis of a method according to a second exemplary embodiment of the present invention. In this connection, the difference with respect to the exemplary embodiment according to FIGS. 4A and 4B is that the carrier layer openings 21*a* are not circular but elliptic. This can be achieved by defocusing the cross-section QT of the laser by means of the focusing apparatus 12 not in a circular but in an elliptic fashion on the carrier layer or this result is also automatically obtained in particular in the feed direction as a result of the speed during cutting (shooting through).

A continuous, elongate, rectangular printed image opening 22*a* (e.g. for printing a contact finger of a front contact for a solar cell) is formed in the structure layer 22. In the region of the printed image opening 22*a*, a row of elliptic carrier layer openings 21*a* is made in the carrier layer 21 located above the structure layer 22, and one web 21*b* each is formed between said openings in the carrier layer 21. The main axis of the elliptic carrier layer openings 21*a* is aligned transversely to the longitudinal direction of the printed image opening 22*a* and is adapted to the width of the printed image opening 22*a* in the transverse direction of the printed image opening 22*a* or corresponds in FIG. 6 substantially to the width of the printed image opening 22*a*.

For printing a contact finger of a front contact for a solar cell, the dimensions might be made in practice e.g. such that the width of the printed image opening 22*a* or the length of the main axes of the elliptic carrier layer openings 21*a* ranges from about 25 to 80 μm and the web width of the webs 21*b* (measured approximately in the thin central region of the web, for example) ranges from 5 μm to 20 μm or preferably from about 10 μm to 15 μm. The above described advantageous effect of the height reduction of the webs 21*b* also occurs by partial melting on the laser entry side from web widths of approximately below 30 μm, in particular approximately at 20 μm.

According to this exemplary embodiment, it is possible to make wider carrier layer openings 21*a* by aligning the wider main axes of the elliptic shape transversely to the longitudinal direction of the printed image opening 22*a*. In an additional and in particular advantageous fashion, the webs 21*b* can be formed on account of the elliptic shape in the case of main axes aligned transversely to the longitudinal direction of the printed image opening 22*a* with a width extending more uniformly in the transverse direction.

Figure 7:
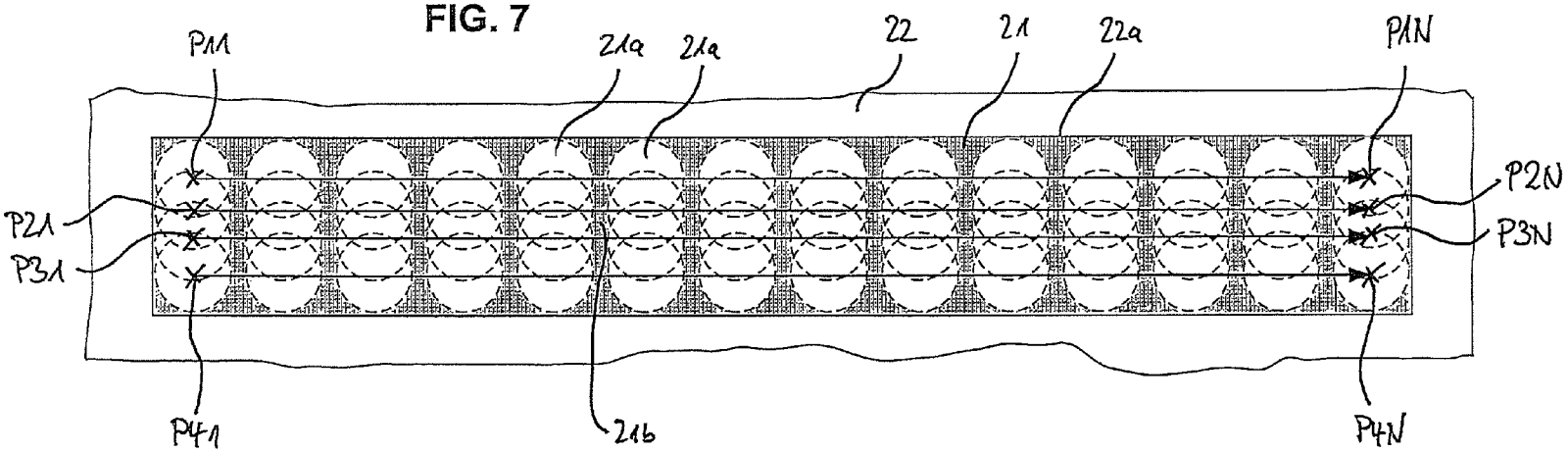
FIG. 7 shows a schematic, structure layer-side top view of a section of a printing stencil, where the carrier layer openings are made on the basis of a method according to a third exemplary embodiment of the present invention.

FIG. 7 shows a schematic, structure layer-side top view of a section of a printing stencil, where the carrier layer openings 21*a* are made on the basis of a method according to a third exemplary embodiment of the present invention. Here, the difference with respect to the exemplary embodiment according to FIGS. 4A and 4B is that the carrier layer openings 21*a* are not circular but are formed in each case of circular carrier layer openings which are arranged in a row extending transversely to the longitudinal direction of the printed image opening and overlap so as to form a single carrier layer opening 21*a*. This can be achieved in analogy to FIGS. 4A and 4B by first making, according to the procedure of FIGS. 5A to 5D, a row of circular (or also elliptic in another exemplary embodiment) carrier layer openings, which extends in the longitudinal direction of the printed image opening 22*a*, according to the shape and depending on the size of the laser cross-section QT of the defocused laser, wherein the focusing device is moved relative to the carrier layer from position P11 to position P1N and then analogously further rows of carrier layer openings, which extend parallel in the longitudinal direction of the printed image opening 22*a*, are made, i.e. by way of example a second row from position P21 to position P2N, a third row from position P31 to position P3N and a fourth row from position P41 to position P4N.

According to this exemplary embodiment, even wider carrier layer openings 21*a* can be made and have a width that is markedly larger than the width of the cross-section QT of the laser, as illustrated in FIG. 7. Here, too, it is possible to observe the above described advantageous effect of the height reduction of the webs 21*b* by partial melting on the laser entry side from web widths of about below 30 μm, in particular at about 20 μm. If the opening is very large, a web extending in parallel between P21 and P31 can be provided to P2N and P3N, respectively, for reasons of strength.

Figure 8:
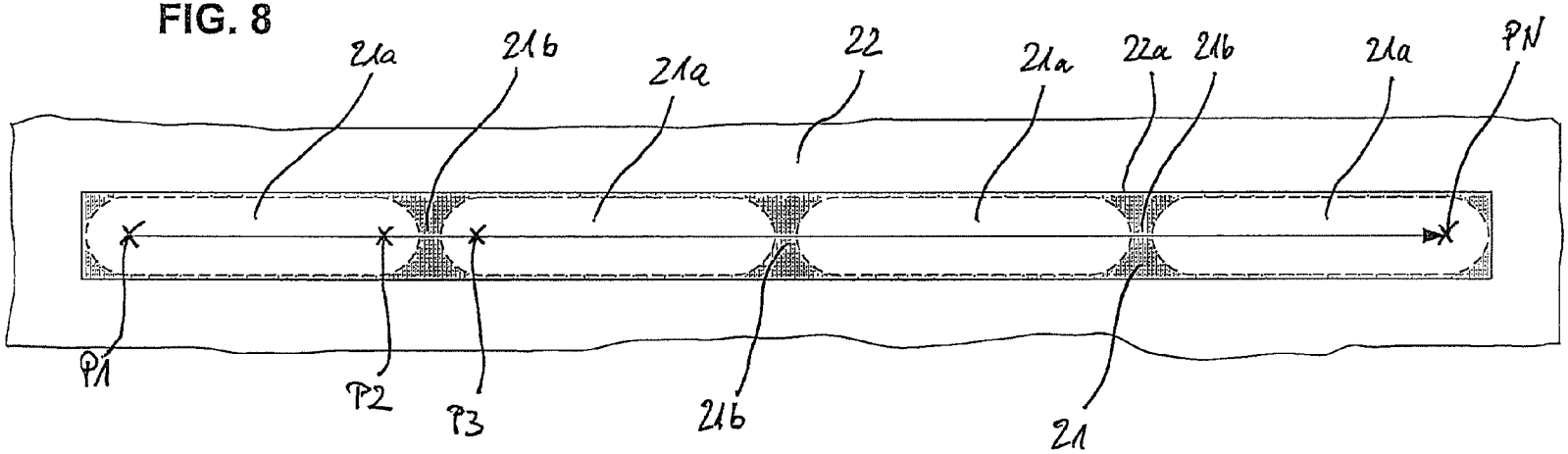
FIG. 8 shows a schematic, structure layer-side top view of a section of a printing stencil, where the carrier layer openings are made on the basis of a method according to a fourth exemplary embodiment of the present invention.

FIG. 8 shows a schematic, structure layer-side top view of a section of a printing stencil, where the carrier layer openings 21*a* are made on the basis of a method according to a fourth exemplary embodiment of the present invention. Here, the carrier layer openings 21*a* are made in each case by means of a laser pulse, wherein the laser cross-section of the defocused laser beam is chosen to be circular, for example. In contrast to the method according to the first exemplary embodiment of the present invention according to FIGS. 4A to 5D, the position of the defocused laser beam is, however, also moved during the laser pulse, i.e. while making the carrier layer openings 21*a* relative to the carrier layer 21 in the longitudinal direction of the printed image opening 22*a* of the structure layer 22 so as to make carrier layer openings having the shape of an oblong hole instead of circular carrier layer openings 21*a*. An oblong hole is an elongate hole the cross-section of which is composed of an elongate rectangular shape, at the longitudinal ends of which a semi-circular shape borders in each case (e.g. semi-circles as in FIG. 8 or also semi-ellipses if an elliptic cross-section of the defocused laser is chosen).

In particular, the laser device 10 is first moved to a position P1 of the first carrier layer opening. During a laser pulse of the pulsed laser, the position of the defocussed laser beam, the defocused cross-section of which was chosen to be e.g. circular in this exemplary embodiment, is moved from the first position P1 to the second position P2 of the carrier layer opening, wherein the feed rate is here chosen substantially so as to correspond to the quotient of the pulse duration of the pulsed laser and the distance of positions P1 and P2. The length of the then made carrier layer opening 21 is, however, larger than the distance of positions P1 and P2 on account of the cross-section of the defocused laser beam (see FIG. 8). In analogy to the above exemplary embodiments, the position of the laser beam is moved between two laser pulses from the second position P2 of the carrier layer opening to a position P3 of the carrier layer opening 21*a* to be subsequently made. The steps are repeated until position PN at the end of the printed image opening is obtained. In connection with this exemplary embodiment, it is likewise possible to adjust elliptic laser cross-sections instead of circular laser cross-sections or also make further rows of carrier layer openings which overlay the carrier layer openings of the first row so as to provide even wider carrier layer openings.

Figure 9:
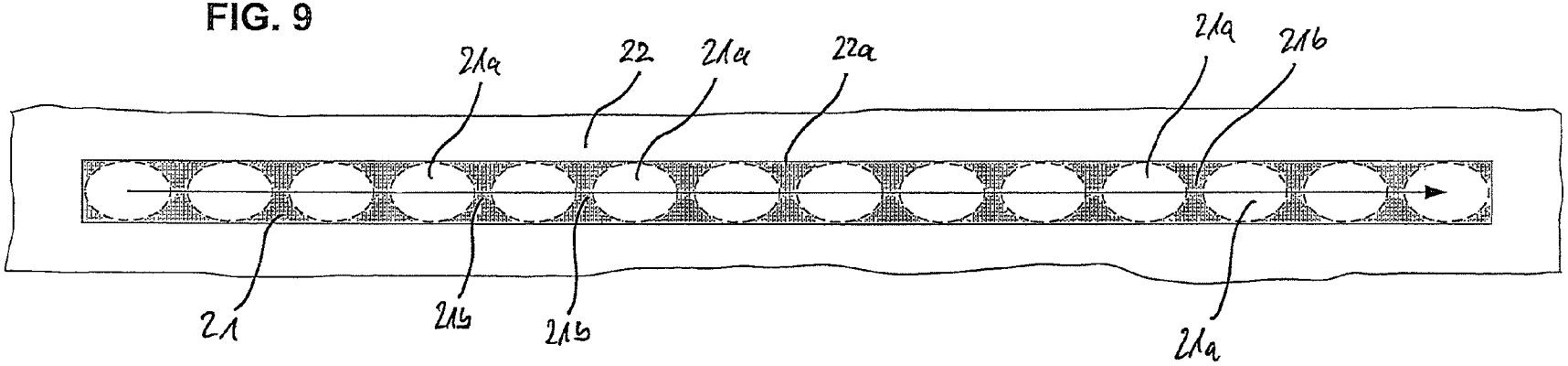
FIG. 9 shows a schematic, structure layer-side top view of a section of a printing stencil, where the carrier layer openings are made on the basis of a method according to a fifth exemplary embodiment of the present invention.

FIG. 9 shows a schematic, structure layer-side top view of a section of a printing stencil, where the carrier layer openings are made on the basis of a method according to a fifth exemplary embodiment of the present invention. The carrier layer openings 21*a* are here oval or elliptic, wherein the longitudinal direction of the carrier layer openings 21*a* extend in the longitudinal direction of the printed image opening 22. For example, this can be achieved by the fact that the stencil is already moved when the laser pulse is not yet switched off, i.e. by "blurring" when the carrier layer openings 21*a* are made.

Figure 10:
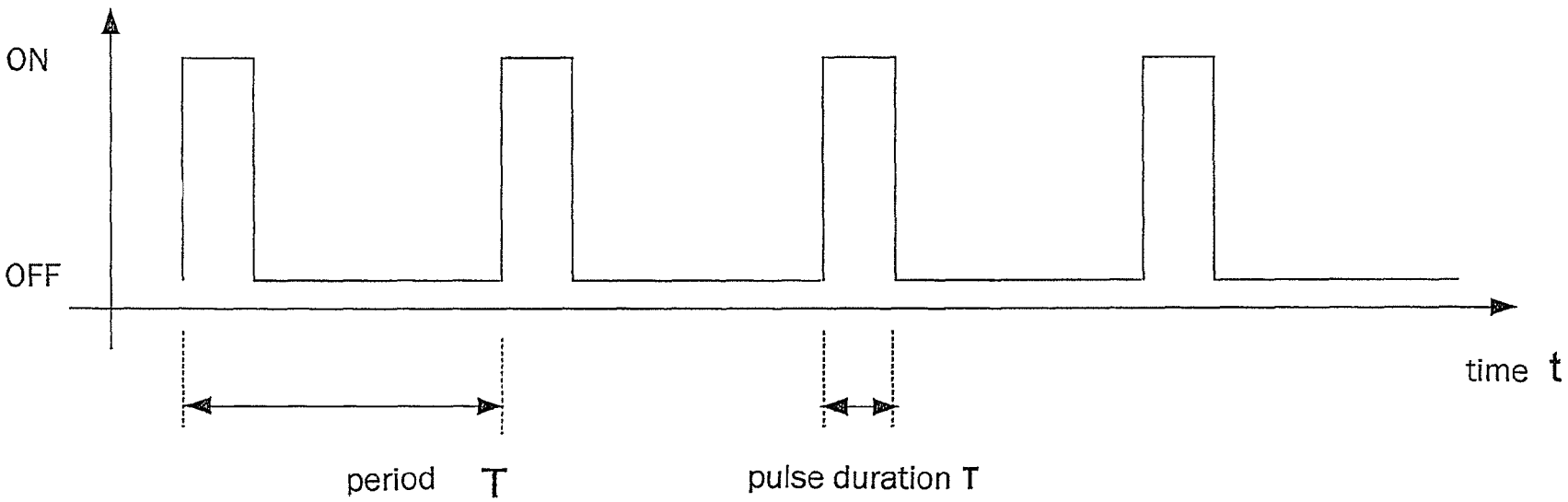
FIG. 10 shows by way of example a temporal pulse progress of a pulsed laser for use in a method according to an exemplary embodiment of the present invention.

FIG. 10 shows by way of example a temporal pulse progress of a pulsed laser which is suited for use in a method according to an exemplary embodiment of the present invention. In this connection, it is not relevant for the invention whether a pulsed laser beam is used or whether a continuous laser beam is used which is "pulsed" by means of a mechanical shutter device by periodic opening and closing of a shutter. According to a pulse frequency of the laser, laser pulses occur periodically according to a period T as illustrated in FIG. 10 and each has a pulse duration $\tau$. The following correlations are obtained. The period corresponds to the inverse value of the frequency, the duty cycle is given by $\tau/T$ and the on/off ratio results from $\tau/(T-\tau)$.

In summary, a manufacturing method for a printing stencil can be provided according to the invention, wherein respective carrier layer openings are made or "shot out" in the carrier layer of the printing stencil in the region of the printed image opening in each case by applying one or several laser pulses at a position. Said manufacturing method can be carried out more easily and more efficiently and with a considerable gain of time compared to manufacturing methods where carrier layer openings are conventionally cut circumferentially out of the carrier layer by means of a highly focused laser beam. Since in particular the task of making the carrier layer opening at a cost-intensive laser cutting device can significantly be reduced, this improved time efficiency additionally signifies a considerably improved cost efficiency for the production of the printing stencil. Furthermore, a printing stencil produced according to the invention shows for process-related reasons structural improvements with respect to printing screens and also printing stencils, where carrier layer openings are conventionally cut circumferentially out of the carrier layer by means of a highly focused laser beam since a considerably improved stability of the carrier layer and an improved doctor blade property are obtained and still an excellent printed image can be achieved, in particular when contact fingers of a front contact for a solar cell are printed.

The invention claimed is:

1. A method for producing a printing stencil for applying a printed pattern on a substrate, comprising:

supplying a carrier layer for the printing stencil, the carrier layer comprising metal, supplying a structure layer for the printing stencil, said layer being located beneath the carrier layer, making a printed image opening, which extends in the longitudinal direction and corresponds to at least part of the printed pattern, in the structure layer, and making carrier layer openings in the carrier layer in the region of the printed image opening by means of a laser beam defocussed depending on the width of the carrier layer opening to be made so as to apply a printing medium to the substrate through the carrier layer openings and the printed image opening.

2. The method according to claim 1, wherein a laser device is used for making the carrier layer openings, said laser device comprising a focusing apparatus and being designed to emit the laser beam in laser pulses and adjust the laser beam by means of the focusing apparatus so as to defocus the laser beam at the height of the surface of the carrier layer depending on the width of the carrier layer openings to be made.

3. The method according to claim 1, wherein the laser beam is defocused in such a way that the width of the cross-section of the laser beam at the height of the surface of the carrier layer is approximately 50% to 95% the width of the carrier layer openings to be made by means of one or several laser pulses.

4. The method according to claim 1, wherein a task of making the carrier layer openings comprises making a row of carrier layer openings, extending in the longitudinal direction of the printed image opening, and the position of the laser beam is moved after making a carrier layer opening between two successive laser pulses relative to the carrier layer and in the longitudinal direction of the printed image opening to a position of the carrier layer opening to be subsequently made.

5. The method according to claim 4, wherein for making a respective carrier layer opening of the row, the position of the laser beam is positioned at a position of the respective carrier layer opening and the respective carrier layer opening is made by means of one or several laser pulses at this position.

6. The method according to claim 5, wherein the position of the laser beam is not moved substantially while making the respective carrier layer opening by means of one or several laser pulses.

7. The method according to claim 4, wherein for making a respective carrier layer opening of the row, the position of the laser beam is positioned at a first position of the respective carrier layer opening and the respective carrier layer opening is made by means of a laser pulse by moving the position of the laser beam during one laser pulse from the first position to a second position of the respective carrier layer opening.

8. The method according to claim 7, wherein the position of the laser beam is moved during one laser pulse from the first position to the second position of the respective carrier layer opening in the longitudinal direction of the printed image opening.

9. The method according to claim 7, wherein a feed rate in the movement of the position of the laser beam relative to the carrier layer from the first position to the second position of the carrier layer opening to be made and/or the pulse duration of the laser pulse of the laser beam are chosen depending on the length of the carrier layer opening to be made.

10. The method according to claim 1, further comprising adjusting a shape and/or size of the cross-section of the defocused laser beam at the height of the surface of the carrier layer by means of a focusing apparatus of the laser device.

11. The method according to claim 10, wherein the width of the cross-section of the defocused laser beam at the height of the surface of the carrier layer is adjusted transversely to the longitudinal direction of the printed image opening depending on the width of the printed image opening.

12. The method according to claim 10, wherein the laser beam is defocused so as to have a substantially circular cross-section at the height of the surface of the carrier layer.

13. The method according to claim 10, wherein the laser beam is defocused to as to have a substantially elliptic cross-section at the height of the surface of the carrier layer.

14. The method according to claim 13, wherein the elliptic main axis of the laser cross-section is aligned transversely, in particular perpendicularly, to the longitudinal direction of the printed image opening.

15. The method according to claim 1, further comprising adjusting one or several of the parameters frequency or period of the pulsed laser beam, pulse duration of the laser pulses, duty cycle of the pulsed laser beam, on/off ratio of the pulsed laser beam.

16. The method according to claim 1, wherein a web is formed in the carrier layer when the position of the laser beam is moved relative to the carrier layer between two successive laser pulses between two adjacent carrier layer openings of the row of carrier layer openings.

17. The method according to claim 16, wherein a feed rate in the movement of the position of the laser beam relative to the carrier layer from a position of a carrier layer opening made to a position of a carrier layer opening to be made is chosen depending on a predetermined web width.

18. The method according to claim 17, wherein the feed rate in the movement of the position of the laser beam relative to the carrier layer from a position of a carrier layer opening made to a position of a carrier layer opening to be subsequently made is additionally chosen depending on the width of the carrier layer openings in the longitudinal direction of the printed image opening.

19. The method according to claim 18, wherein the feed rate in the movement of the laser beam relative to the carrier layer from the position of a carrier layer opening made to the position of a carrier layer opening to be subsequently made is chosen to be smaller or substantially equal $(BL+SB)/(T-\tau)$, wherein BL designates the width of the carrier layer openings in the longitudinal direction of the printed image opening, SB designates the predetermined web width, T is the period of the pulsed laser beam and $\tau$ is the pulse duration of the laser pulses.

20. The method according to claim 1, wherein a focusing apparatus of the laser device and/or the carrier layer is moved when the position of the laser beam is moved relative to the carrier layer.

21. The method according to claim 4, wherein the task of making the carrier layer openings comprises making at least one further second row of carrier layer openings, extending in the longitudinal direction of the printed image opening and parallel to the first row of carrier layer openings.

22. The method according to claim 21, wherein in each case a carrier layer opening of the first row is overlaid with a carrier layer opening of the at least one further second row in such a way that each carrier layer opening is formed in the produced printing stencil from two or more carrier layer openings of the at least two rows, wherein a web is formed between carrier layer openings adjacent in the longitudinal direction of the printed image opening.

23. A printing stencil for applying a printed pattern to a substrate, which is produced according to a method of claim 1, comprising:

a carrier layer for the printing stencil, the carrier layer comprising, metal, a structure layer for the printing stencil, said layer being located beneath the carrier layer, wherein the structure layer has an elongate printed image opening, corresponding to at least part of the printed pattern, in the structure layer, and wherein in the region of the printed image opening the carrier layer comprises one or several rows of carrier layer openings, extending in the longitudinal direction of the printed image opening.

24. The printing stencil according to claim 23, wherein the carrier layer openings of a row are formed in a substantially circular fashion.

25. The printing stencil according to claim 23, wherein the carrier layer openings of a row are formed in a substantially elliptic fashion.

26. The printing stencil according to claim 25, wherein the elliptic main axis of the carrier layer openings of a row are aligned transversely, in particular perpendicularly, to the longitudinal direction of the printed image opening.

27. The printing stencil according to claim 23, wherein the carrier layer openings of a row have substantially the shape of an oblong hole.

28. The printing stencil according to claim 23, wherein the carrier layer has precisely one row of carrier layer openings, extending in the longitudinal direction of the printed image opening, in the region of the printed image opening, wherein a respective web is formed between adjacent carrier layer openings, said web being partially molten on the structure layer side and being thus reduced in height compared to the thickness of the carrier layer.

29. The printing stencil according to claim 23, wherein in each case a carrier layer opening of a first row is overlaid with a carrier layer opening of at least one further second row in such a way that each carrier layer opening is formed in the printing stencil from two or more carrier layer openings of the at least two rows, wherein a respective web is formed between carrier layer openings adjacent in the longitudinal direction of the printed image opening.

* * * * *